United States Patent [19]

Boyama

[11] 4,297,977

[45] Nov. 3, 1981

[54] IGNITION SYSTEM FOR AN INTERNAL COMBUSTION ENGINE

[75] Inventor: Kimihiro Boyama, Shizuoka, Japan

[73] Assignee: Kokusan Denki Co., Ltd., Numazu, Japan

[21] Appl. No.: 113,355

[22] Filed: Jan. 18, 1980

[30] Foreign Application Priority Data

Jan. 19, 1979 [JP] Japan ..... 54-5500[U]

[51] Int. Cl.[3] ..... F02B 31/00

[52] U.S. Cl. ..... 123/320; 123/335; 123/599

[58] Field of Search ..... 123/32 EL, 148 CC, 118, 123/97 B, 198 DC, 325, 320, 335

[56] References Cited

U.S. PATENT DOCUMENTS

| | | | |
|---|---|---|---|
| 2,656,827 | 10/1953 | Conover | 123/118 |
| 3,463,130 | 8/1969 | Reichardt | 123/32 EL |
| 3,572,302 | 3/1971 | Wollesen | 123/118 |
| 3,758,736 | 9/1973 | Tanaka | 123/198 DC |
| 3,776,204 | 12/1973 | Harris | 123/118 |
| 3,974,809 | 8/1976 | Kondo | 123/118 |
| 3,985,109 | 10/1976 | Kondo | 123/97 B |
| 4,136,660 | 1/1979 | Palmer | 123/118 |
| 4,198,933 | 4/1980 | Seiber | 123/118 |

*Primary Examiner*—Ronald B. Cox

*Attorney, Agent, or Firm*—Pearne, Gordon, Sessions, McCoy & Granger

[57] ABSTRACT

This invention relates to an ignition system for an internal combustion engine. The ignition system comprises an ignition circuit to generate a spark at an ignition plug in synchronism with a rotation of the internal combustion engine. The ignition circuit may be of a capacitor discharging type or of an ignition primary current interrupting type. The ignition system further comprises an ignition preventing circuit to prevent the ignition circuit from being operated when the internal combustion engine is rotated at a speed of revolution higher than a first set value of r.p.m. and when a throttle valve operating member is quickly returned to a position at which the r.p.m. of the engine is lower than the second set value of r.p.m. which is lower than the first set value of r.p.m. The ignition preventing circuit may be adapted to fully prevent the operation of the ignition circuit. Alternatively, the ignition preventing circuit may be adapted to thin the operation of the ignition circuit.

4 Claims, 5 Drawing Figures

IGNITION SYSTEM FOR AN INTERNAL COMBUSTION ENGINE

BACKGROUND OF THE INVENTION

In the prior arts, there have been proposed various ignition systems for an internal combustion engine in which an ignition preventing circuit is provided to prevent an ignition circuit from being operated when a revolution per minute of the engine is higher than a critical one. However, such ignition systems cannot reduce the r.p.m. of the engine when an operator returns a throttle valve operating member in order to avert danger because it takes substantial time to reduce the r.p.m. of the engine. Furthermore, in a snowmobile having such ignition systems provided, even though the throttle valve operating member is returned, a throttle valve cannot be sometimes returned because a throttle wire freezes. This prevent the r.p.m. of the engine from being reduced.

SUMMARY OF THE INVENTION

Accordingly, it is a principal object of the invention to provide an ignition system for an internal combustion engine wherein the speed of revolution per minute of the engine can be quickly reduced when a throttle valve operating member is quickly reduced in order to avert danger.

It is another object of the invention to provide an ignition system for an internal combustion engine wherein the engine speed can be slowly reduced when a throttle valve operating member is moderately returned.

It is further object of the invention to provide an ignition system for an internal combustion engine wherein an explosion noise is never generated in a muffler, which tends to occur due to remaining gases in an exhaust system.

In accordance with the invention, there is provided an ignition system for an internal combustion engine comprising an ignition circuit to generate a spark at an ignition plug in synchronism with a rotation of the internal combustion engine, said ignition system further comprising an ignition preventing circuit to prevent said ignition circuit from being operated when the internal combustion engine is being rotated at a speed of revolution higher than a first set value of revolution per minute and when a throttle valve operating member is returned to a position at which the internal combustion engine is to be rotated at a revolution per minute lower than a second lower set value of revolutions per minute.

BRIEF DESCRIPTION OF THE DRAWINGS

The above and other objects and features of the invention will be apparent from the description of the embodiments taken with reference to the accompanying drawings in which.

DETAILED DESCRIPTION OF THE EMBODIMENTS

Figure 1:
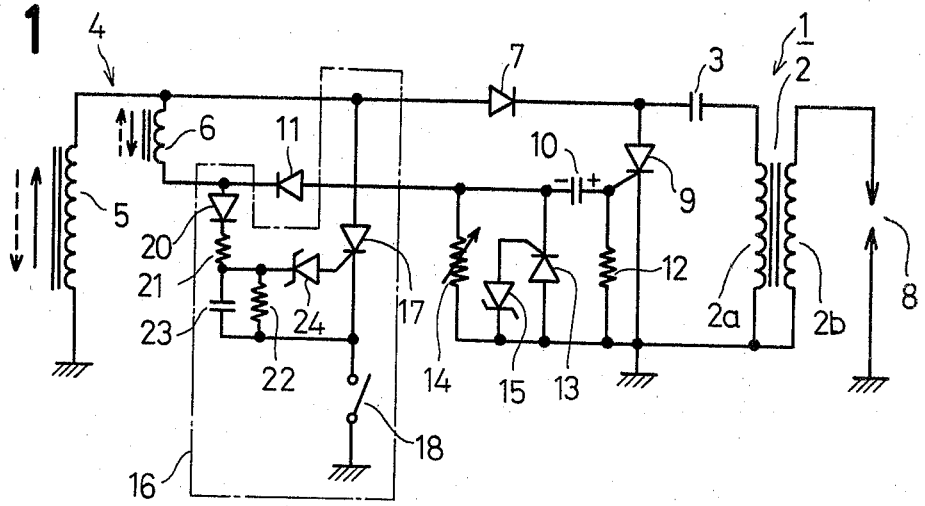
FIG. 1 is a schematic diagram of one embodiment of an ignition system for an internal combustion engine constructed in accordance with the invention.

Referring now to FIG. 1, there is shown an ignition system for an internal combustion engine constructed in accordance with one embodiment of the invention. The ignition system comprises a capacitor discharging type ignition circuit 1 which includes an ignition coil 2, a capacitor 3 and an ignition electric source 4. The ignition electric source 4 which may be in the form of magneto has a first generating coil 5 and a second generating coil 6 provided therein. The first generating coil 5 at one end is connected to one end of a primary coil 2*a* of the ignition coil 2 through a forwarded diode 7 and through the capacitor 3 and at the other end is grounded. An ignition plug 8 at one end is connected to one end of a secondary coil 2*b* of the ignition coil 2. The other ends of the primary and secondary coils 2*a* and 2*b* of the ignition coil 2 and the ignition plug 8 are grounded.

An igniting thyristor 9 has an anode connected to the point of junction between the diode 7 and the capacitor 3 and a cathode connected to the other end of the primary coil 2*a* of the ignition coil 2. A capacitor 10 has one end connected to the gate of the igniting thyristor 9 and the other end connected through a forwarded diode 11 to one end of the second generating coil 6 of the ignition electric source 4, the other end of which is connected to the point of junction between the first generating coil 5 of the ignition electric source 4 and the diode 7. An electric resistor 12 has one end connected to the point of junction between the capacitor 10 and the gate of the igniting thyristor 9 and the other end connected to the cathode of the igniting thyristor 9. Another thyristor 13 has a cathode connected to the point of junction between the capacitor 10 and the diode 11 and an anode connected to the other end of the electric resistor 12. A variable electric resistor 14 is connected in parallel to the thyristor 13 and a Zener diode 15 has anode connected to the gate of the thyristor 13 and a cathode connected to the point of junction between the anode of the thyristor 13 and the variable electric resistor 14.

When an output signal indicated by the solid arrow is generated from the first generating coil 5 of the ignition electric source 4, the electric capacitor 3 is charged through the diode 7 and the primary coil 2*a* of the ignition coil 2. When an output signal indicated by the broken arrow is generated from the second generating coil 6, the capacitor 10 is charged through the diode 7, the anode and gate of the igniting thyristor 9 and the diode 11. When the voltage across the capacitor 10 exceeds the Zener voltage of the Zener diode 15, the Zener diode 15 is turned on to discharge the capacitor 10 through the gate and cathode 9 of the igniting thyristor 9, the electric resistor 12, the Zener diode 15 and the gate and cathode of the thyristor 13. This causes the thyristors 9 and 13 to be turned on. Thus, the capacitor 3 is discharged through the first thyristor 9 and the primary coil 2*a* of the ignition coil 2 whereby a high voltage is established across the secondary coil 2*b* of the ignition coil to generate a spark at the ignition plug 8. Since the ignition electric source generates the outputs in synchronism with the rotation of the internal combustion engine, the sparks can be generated at the ignition positions of the engine.

Figure 2:
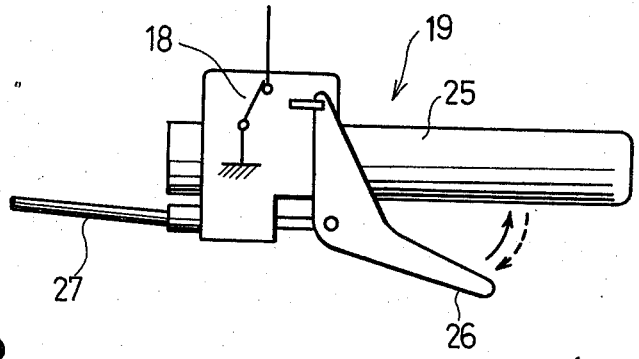
FIG. 2 illustrates a throttle valve operating member with a throttle position detecting switch provided therein.

The ignition system of the invention further comprises an ignition preventing circuit 16 to prevent the ignition circuit 1 from being operated when the internal combustion engine is being rotated at a speed of revolution higher than a first set value of revolution per minute and when a throttle valve operating member is returned to a position at which the internal combustion engine is to be rotated at a revolution per minute lower than a second set value of revolution per minute (r.p.m.). The ignition preventing circuit 16 includes an ignition preventing thyristor 17 with its anode connected to the point of junction between the first and second generating coils 5 and 6 of the ignition electric source 4 and the diode 7, and with its cathode grounded through a throttle position detecting switch 18 in a throttle valve operating member 19 which is in the form of lever as shown in FIG. 2. A diode 20 and electric resistors 21 and 22 are connected in series to each other with an anode of the diode 20 connected to the point of junction between the one end of the second generating coil 6 and the cathode of the diode 11 and with an outer end of the electric resistor 22 connected to the cathode of the ignition preventing thyristor 17. A capacitor 23 is connected in parallel to the electric resistor 22. There is provided a Zener diode 24 an anode of which is connected to the gate of the ignition preventing thyristor 17 and a cathode of which is connected to the point of junction between the electric resistors 21 and 22.

As shown in FIG. 2, the throttle valve operating member 19 comprises a grip 25 for a car and a throttle lever 26 which is connected to a throttle wire 27 for controlling an opening degree of a throttle valve not shown. The throttle position detecting switch 18 is provided on the grip 25 so that it is closed when the throttle lever 26 is at a position at which the internal combustion engine is to be rotated at an r.p.m. lower than a given r.p.m.

Since the electric resistors 21 and 22 serve as a voltage divider, the voltage across the electric resistor 22 which appears when the switch 18 is closed is substantially in proportion to the output voltages of the first and second generating coils 5 and 6 of the ignition electric source 4 and therefore the r.p.m. of the engine. When the voltage across the electric resistor 22 exceeds the Zener voltage of the Zener diode 24, the latter is turned on to apply a firing signal to the gate of the ignition preventing thyristor 17. There is a maximum r.p.m. at which the engine may be operated, which, merely as an example, might be 8000 r.p.m. There is a lower speed of the engine which is the minimum r.p.m. at which the Zener diode will conduct. This will be referred to later as a high or first set value of r.p.m. That first set value is so determined to be higher than a low or second set value of r.p.m. which is the r.p.m. below which the throttle position detecting switch 18 is closed. For example, the high set value of r.p.m. of the engine is 2,000 r.p.m. while the low set value of r.p.m. of the engine is 500 r.p.m. Thus, it will be noted that the ignition preventing circuit 16 is operated when the actual r.p.m. of the engine is higher than the high set value of r.p.m. and when the throttle lever 26 is at the position at which the engine is to be rotated at the r.p.m. lower than the low set value of r.p.m.

In operation, after the internal combustion engine starts to be operated, a movement of the throttle lever 26 in the direction indicated by the arrow of solid line in FIG. 2 causes the opening degree of the throttle valve to be increased so that the r.p.m. of the engine becomes higher gradually. When the r.p.m. of the engine is relatively low, the throttle position detecting switch 18 is closed, but the ignition preventing thyristor 17 is never fired because the voltage across the electric resistor 22 is lower than the Zener voltage of the Zener diode 24. Therefore, the charge and the discharge of the capacitor 3 are repeated in synchronism with the rotation of the engine with the result that the igniting operation is normally made.

The throttle lever 26 is further moved until it exceeds the position corresponding to the low set value of r.p.m. of the engine. At that time, the throttle position detecting switch 18 is open, and the r.p.m. of the engine becomes higher because the ignition preventing circuit 16 has no effect on the ignition circuit 1.

The throttle lever 26 is further moved until the r.p.m. of the engine exceeds the high set value of r.p.m. As described hereinabove, since the throttle position detecting switch 18 is already open, the ignition preventing circuit 16 is never operated and the igniting operation is maintained.

In case the throttle lever 26 is slowly returned toward the position at which the engine is to be rotated at the lower r.p.m., the r.p.m. of the engine is gradually decreased and the throttle position detecting switch 18 is closed at the r.p.m. of the engine corresponding to the low set value of r.p.m.

Meantime, in case the throttle lever 26 is quickly returned toward the idling position at which the engine is to be rotated at a lower r.p.m. when the engine is being actually rotated at the r.p.m. higher than the high or first set value of r.p.m., the throttle position detecting switch 18 is closed, but the engine is being rotated at the r.p.m. higher than the high or first set value of r.p.m. because there is a delay of variation r.p.m. of the engine relative to the movement of the throttle lever 26. At that time, the voltage across the electric resistor 22 is higher than the Zener voltage of the Zener diode 24. Thus, it will be noted that the ignition preventing thyristor 17 is turned on with the result that the charging current which is to flow through the electric capacitor 3 is shorted therefrom. This prevents the ignition circuit from being operated and causes the r.p.m. of the engine to be quickly decreased. When the r.p.m. of the engine is lower than the high or first set value of r.p.m., the ignition preventing thyristor 17 is turned off because the voltage across the electric resistor 22 is lower than the Zener voltage of the Zener diode 24, which permits the engine to be idled.

Figure 3:
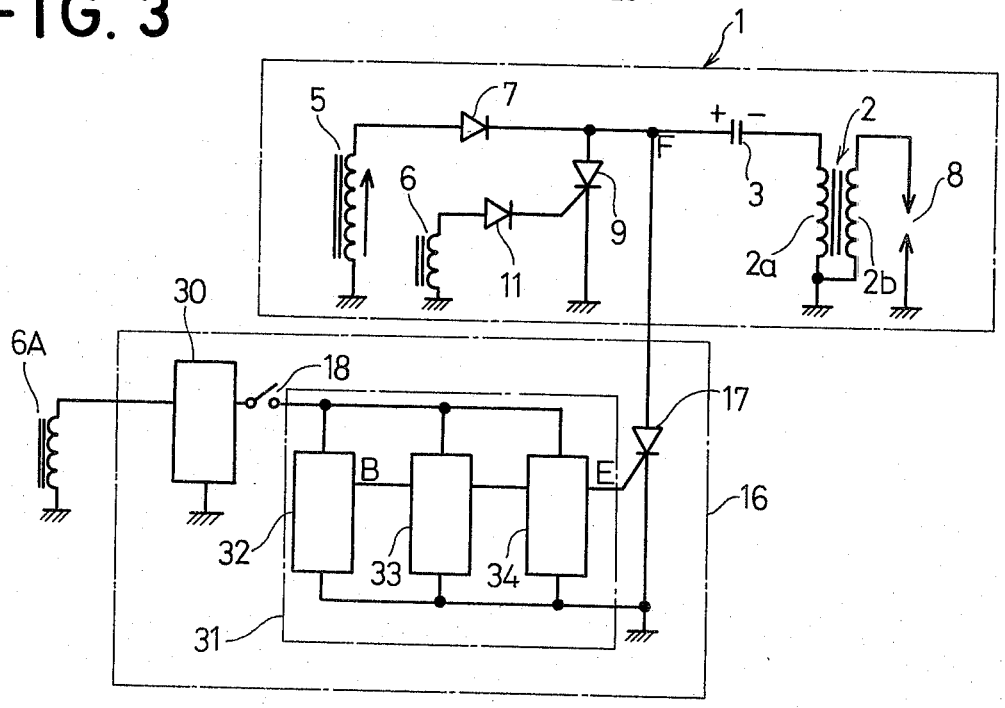
FIG. 3 is a schematic diagram of another embodiment of the invention.

FIG. 3 shows another embodiment of the ignition system of the invention in which the ignition circuit 1 is substantially identical to that of the embodiment of FIG. 1 except that the second generating coil 6 is connected through the diode 11 to the gate of the igniting thyristor 9. In the embodiment of FIG. 3, the second generating coil 6 of the ignition electric source 4 generates an output signal therefrom everytime the engine reaches the ignition position. In FIG. 3, the same numerals designate the same components.

In the embodiment of FIG. 3, the ignition preventing circuit 16 comprises an ignition preventing electric source 30, a pluse signal generator 31 connected through the throttle position detecting switch 18 in the throttle valve operating member. The pulse signal generator 31 comprises an oscillating circuit 32 to oscillate when the throttle position detecting switch 18 is closed, a duty control circuit 33 to receive an output pulse from the oscillating circuit 32 to determine the duty of turning on or off the ignition preventing thyristor 17, and an amplifying circuit 34 to amplify a pulse signal from the duty control circuit 33. The output of the amplifying circuit 34 is connected across the gate and cathode of the ignition preventing thyristor 17. A third generating coil 6A may be disposed in the ignition electric source 4 to drive loads such as a headlamp and so on. The throttle position detecting switch 18 may be mounted on the throttle valve operating member in the same manner as shown in FIG. 2 and is closed when the throttle valve operating member is at the position at which the engine is to be rotated at the r.p.m. lower than a low set value of r.p.m. which corresponds to an r.p.m. slightly higher than an idling r.p.m. At that time, a normal load is supposed to be applied to the engine.

Figure 4:
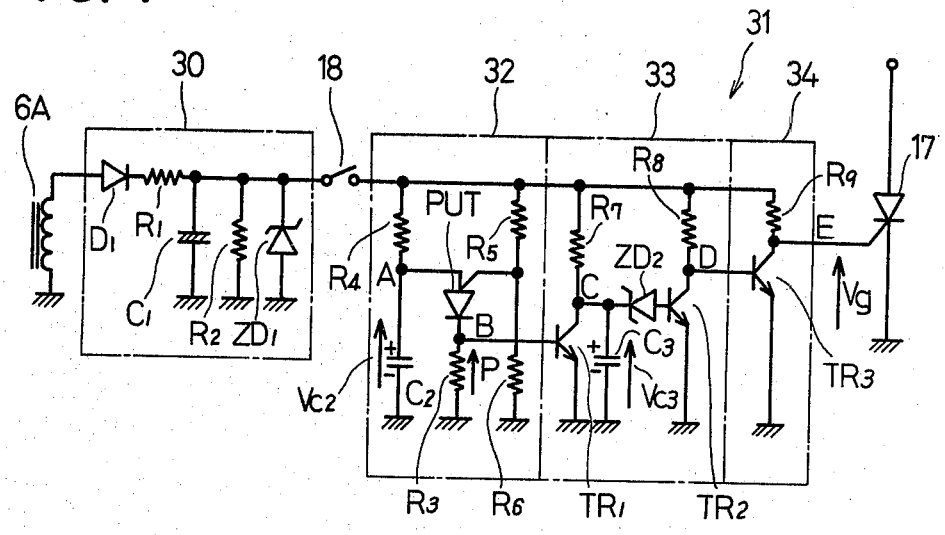
FIG. 4 is a schematic diagram of an ignition preventing circuit used in the embodiment of FIG. 3.

As shown in FIG. 4, the ignition preventing electric source 30 comprises a diode $D_1$ having an anode connected to the non-grounded end of the third generating coil 6A of the electric source 4, an electric resistor $R_1$ having one end connected to the cathode of the diode $D_1$, a capacitor $C_1$ having one end connected to the other end of the electric resistor $R_1$ and the other end grounded, and an electic resistor $R_2$ and a Zener diode $ZD_1$ connected in parallel to the capacitor $C_1$. The ignition preventing electric source 30 generates an output substantially equal to the peak value of the output voltage of the third generating coil 6A when the latter is lower than the Zener voltage of the Zener diode $ZD_1$, and generates a constant voltage equaling to the Zenor voltage of the Zener diode $ZD_1$ when the peak value of the output voltage from the third generating coil 6A exceeds the Zener voltage of the Zener diode $ZD_1$.

Figure 5:
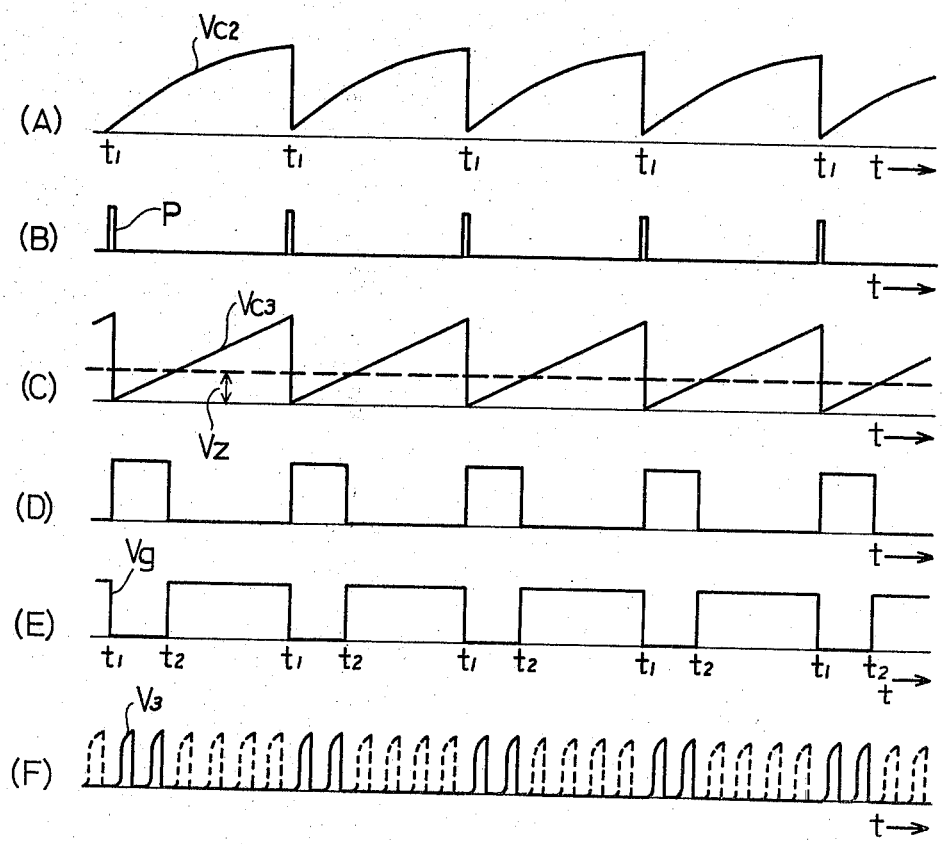
FIG. 5 shows waveforms of signals at portions of the circuits of FIGS. 3 and 4.

As also shown in FIG. 4, the oscillating circuit 32 which may be in the form of relaxation oscillator comprises a programmable unijunction transistor PUT. The cathode of the PUT is grounded through an electric resistor $R_3$, and an electric capacitor $C_2$ is connected between the anode of the PUT and earth. The anode of the PUT is connected to one end of an electric resistor $R_4$, the other end of which is connected through the throttle position detecting switch 18 to the non-grounded end of the electric source 30. An electric resistor $R_5$ is connected between the point of junction between the position detecting switch 18 and the electric resistor $R_4$ and the gate of the PUT, while an electric resistor $R_6$ is connected between the gate of the PUT and earth. An output terminal of the oscillating circuit 32 is led from the non-grounded end of the electric resistor $R_3$ or the cathode of the PUT. The capacitor $C_2$ is charged from the electric source 30 through the electric resistor $R_4$ with the polarities shown in FIG. 2. FIG. 5(A) shows the voltage across the capacitor $C_2$ or the potential at the point A of FIG. 2 which varies with time. When the voltage across the capacitor $C_2$ increasing with time exceeds the gate biasing voltage of the PUT (which corresponds to the voltage across the electric resistor $R_6$), the PUT becomes conductive because of its negative resistance characteristics. This causes the capacitor $C_2$ to be discharged through the anode and cathode of the PUT and through the electric resistor $R_3$. Thus, a narrow pulse voltage P is established across the electric resistor $R_3$ every time the capacitor $C_2$ is discharged. When the discharge of the capacitor $C_2$ is finished, the PUT is turned off. Then, the capacitor $C_2$ is charged to prepare for the above operation of the oscillating circuit 32. FIG. 5(B) shows the pulse P periodically established across the electric resistor $R_3$ or at the point B of FIG. 4.

As shown in FIG. 4, the duty control circuit 33 comprises an npn transistor $TR_1$ to the base and emitter of which the pulses from the oscillating circuit 32 are applied. The collector of the transistor $TR_1$ is connected through an electric resistor $R_7$ and the throttle position detecting switch 18 to the non-grounded end of the electric source 30. A capacitor $C_3$ is connected between the collector and emitter of the transistor $TR_1$ while the point of junction between the capacitor $C_3$ and the collector of the transistor $TR_1$ is connected through a Zener diode $ZD_2$ to a base of an npn transistor $TR_2$. The transistor $TR_2$ has a collector connected through an electric resistor $R_8$ and the position detecting switch 18 to the non-grounded end of the electric source and has an emitter grounded. The narrow pulse P from the oscillating circuit 32 permits the transistor $TR_1$ to be momentarily turned on to thereby discharge the capacitor $C_3$. After that, the transistor $TR_1$ is turned off. The capacitor $C_3$ is charged from the electric source 30 through the electric resistor $R_7$ with the polarities shown in FIG. 4 while the transistor $TR_1$ is nonconductive. FIG. 5(C) shows the voltage $V_{c3}$ across the capacitor $C_3$ (at the point C of FIG. 4) which varies with time so as to form a saw tooth wave. When the voltage $V_{c3}$ exceeds the Zener voltage of the Zener diode $ZD_2$, a base current flows through the base and emitter of the transistor $TR_2$ to turn it on. Thus, every time the transistor $TR_2$ is turned on, a rectangular wave pulse is generated at the collector of the transistor $TR_2$ or at the point D of the duty control circuit 34.

As shown in FIG. 4, the amplifying circuit 34 comprises an npn transistor $TR_3$ and an electric resistor $R_9$. The base of the transistor $TR_3$ is connected to the collector of the transistor $TR_2$ in the duty control circuit 33 while the emitter of the transistor $TR_3$ is grounded. The collector of the transistor $TR_3$ is connected through the electric resistor $R_9$ and the throttle position detecting switch 18 to the non-grounded end of the electric source 30 and also directly to the gate of the ignition preventing thyristor 17. The amplifying circuit 34 serves to reverse the output from the duty control circuit 33 to apply a rectangular control signal $V_g$ shown in FIG. 5(E) to the thyristor 17.

The output voltage from the electric source 30 is too low to generate the control signal $V_g$ from the amplifying circuit 34 until the r.p.m. of the engine reaches a high set value of r.p.m. slightly higher than the low set value of r.p.m. This is accomplished by the fact that the output voltage from the electric source 30 at the r.p.m. of the engine lower than the high set value of r.p.m. never breaks down the Zener diode $ZD_2$ which is accomplished by the voltage across the capacitor $C_3$ of the duty control circuit 33.

Let it be supposed that the normal load is applied to the engine and that the engine is normally accelerated from the idling condition. While the r.p.m. of the engine is lower than the low set value of r.p.m., the throttle position detecting switch 18 is closed, but the ignition preventing thyristor 17 is not conductive because the voltage of the electric source 30 is too low to generate the control signal $V_g$ from the amplifying circuit 34. Therefore, the ignition circuit 1 is normally operated to ignite the engine.

When the revolution of the engine reaches the high set value of r.p.m. higher than the low set value of r.p.m., the output voltage from the electric source 30 reaches the one enough to generate the control signal $V_g$ from the amplifying circuit 34, but since at that time the throttle position detecting switch 18 is open, the control signal $V_g$ is never generated. Therefore, the ignition preventing thyristor 17 is never also turned on and the engine is normally operated to be accelerated.

In case that the throttle valve operating member is slowly returned, the r.p.m. of the engine follows the movement of the throttle valve operating member to be decelerated. When the r.p.m. of the engine becomes lower than the high set value of r.p.m., the output voltage of the electric source 30 is too low to generate the control signal $V_g$ from the amplifying circuit 34. Thus, the ignition preventing thyristor 17 is never turned on and, as a result, the ignition preventing circuit 16 is never operated. This causes the ignition circuit to be normally operated.

In case that the throttle valve operating member is quickly returned to the position corresponding to an r.p.m. lower than the low set value of r.p.m. while the engine is being rotated at high r.p.m., higher than the high set value of r.p.m., the throttle position detecting switch 18 is closed to generate the control signal $V_g$ from the amplifying circuit 34 because the voltage of the electric source 30 is enough high to generate it. While the control signal $V_g$ is generated, the ignition preventing thyristor 17 is turned on every time the voltage which causes the anode of the thyristor 17 to be positive is generated at the third generating coil 6A. Thus, it will be noted that the capacitor 3 is not charged every time the voltage is generated at the third generating coil 6A. Therefore, while the control signal $V_g$ is generated from the amplifying circuit 34, the sparks which are to be generated at the ignition plug 8 are thinned, which causes the engine to be intermittently ignited. The r.p.m. of the engine is quickly decelerated by this. When the r.p.m. of the engine becomes lower than the high set value, the control signal $V_g$ is no longer generated from the amplifying circuit 34, and as a result the ignition circuit 1 is normally operated. FIG. 5(F) shows the voltage $V_3$ of the capacitor 3 of the ignition circuit 1 when the control voltage $V_g$ is generated. In this figure, the waveforms indicated at broken lines are the voltage waves which are to be charged at the capacitor 3 if the control signal $V_g$ is not generated. As noted from FIG. 5(F), the capacitor 3 is prevented from being charged continuously four times and therefore continuous four sparks are prevented from being generated.

It should be noted that the period of the control signal $V_g$ is constant in spite of variation in the revolution of the engine. Therefore, the number of the sparks which are thinned by the ignition preventing circuit 16 varies on the r.p.m. of the engine. As the r.p.m. of the engine is high, the number of the sparks to be thinned is increased. This quickly decreases the r.p.m. of the engine. It should be noted that the number of the sparks which are thinned is decreased as the r.p.m. of the engine is lowered. This causes the ignition system to be transferred to the normal ignition in a smooth manner. Thus, the explosion noise in the muffler or the mechanical shock is avoided.

It is when the engine has the normal load applied thereto that the engine is rotated at the low set value at the position of the throttle valve operating member corresponding to the low set value. Practically, the r.p.m. at which the engine is rotated at various positions of the throttle valve operating member varies on the loading conditions of the engine such as the condition of the road surface and so on. The r.p.m. at which the engine is rotated sometimes tends to be higher than the low set value of r.p.m. even if the throttle valve operating member is positioned corresponding to the low set value. This occurs if the road surface freezes so that the load applied to the engine is relatively lighter. In this case, if the engine is rotated at the r.p.m. higher than the high set value, the thinned ignition is made and, therefore, the r.p.m. of the engine is caused to be lowered by the thinned ignition. However, if the load applied to the engine is relatively larger, the r.p.m. at which the engine is rotated sometimes tends to be lower than the low set value even if the throttle valve operating member is positioned corresponding to the low set value. In this case, the thinned ignition is not necessary and is not made by the ignition system of FIG. 3.

It will be understood that the low set value of r.p.m. may be set at the idling r.p.m. In this case, the throttle position detecting switch 18 is arranged to be closed when the throttle valve operating member is returned to the free position at which the engine is to be rotated at the lowest r.p.m.

Although two preferred embodiments of the invention have been described and illustrated with reference to the accompanying drawings, it will be understood to those skilled in the art that they are by way of example, and that various changes and modifications may be made without departing from the spirit and scope of the invention. For example, in the embodiments of FIGS. 1 and 3, the throttle valve operating member may be mounted on an accelerating pedal or on a throttle pedal. In the embodiment of FIG. 4, the oscillating circuit 32 may be formed of a unijunction transistor instead of the PUT and alternatively the oscillating circuit 32 and the duty control circuit 33 may be composed of an asymmetrical unstable multivibrator. Also, in the embodiment of FIG. 4, the throttle position detecting switch 18 may be provided between the output of the pulse signal generator 31 and the gate of the ignition preventing thyristor 17. Furthermore, in the embodiments of FIGS. 1 and 3, the igniting thyristor 9 may serve as the ignition preventing thyristor 17. The ignition preventing thyristor 17 may be provided so as to short the second generating coil 6. It will be noted that an ignition preventing semiconductor switch may be provided instead of the thyristor 17 and arranged to interrupt the ignition circuit 1 to prevent it from being operated. Such an ignition preventing switch may be of multistage transistors. It will be also noted that the invention may be applied to a primary current interrupting type ignition system in place of a capacitor discharging type ignition system. Thus, it will be understood that the invention is intended to be defined only by the appended claims.

What is claimed is:

1. An ignition system for an internal combustion engine having a throttle valve operated by a throttle valve operating member, the ignition system comprising an ignition circuit to generate a spark at an ignition plug in synchronism with the rotation of the internal combustion engine, said ignition system further comprising an ignition preventing circuit to prevent said ignition circuit from being operated when the internal combustion engine is being rotated at a speed of revolution higher than a first set value of revolutions per minute while said throttle valve operating member is returned to a position at which the internal combustion engine is to be rotated at a speed of revolution lower than a second set value of revolutions per minute which is lower than said first set value of revolutions per minute, said ignition preventing circuit comprising an ignition preventing semiconductor switch provided in said ignition circuit to prevent said ignition circuit from being operated when said ignition preventing semiconductor switch is operated, and a control signal generator provided to supply a control signal to said ignition preventing semiconductor switch at a given period when the internal combustion engine is being rotated at a speed of revolution higher than said first set value while said throttle valve operating member is returned to said position corresponding to a speed of revolution lower than said second set value, said ignition preventing circuit further comprising a throttle position detecting switch to detect the position of said throttle valve operating member, said control signal generator comprising an electric source to generate an output voltage increasing with the revolutions per minute of the engine and to rectify said output voltage into a DC voltage, a pulse generating circuit to receive said DC voltage to generate a pulse signal having a constant period, and said pulse generating circuit being connected to said ignition preventing semiconductor switch to apply said pulse signal as said control signal to said ignition preventing semiconductor switch.

2. An ignition system for an internal combustion engine having a throttle valve operated by a throttle valve operating member, the ignition system comprising an ignition circuit to generate a spark at an ignition plug in synchronism with the rotation of the internal combustion engine, said ignition system further comprising an ignition preventing circuit to prevent said ignition circuit from being operated when the internal combustion engine is being rotated at a speed of revolution higher than a first set value of revolutions per minute while said throttle valve operating member is returned to a position at which the internal combustion engine is to be rotated at a speed of revolution lower than a second set value of revolutions per minute which is lower than said first set value of revolutions per minute, said ignition preventing circuit comprising an ignition preventing semiconductor switch provided in said ignition circuit to prevent said ignition circuit from being operated when said ignition preventing semiconductor switch is operated, and a control signal generator provided to supply a control signal to said ignition preventing semiconductor switch at a given period when the internal combustion engine is being rotated at a speed of revolution higher than said first set value while said throttle valve operating member is returned to said position corresponding to a speed of revolution lower than said second set value, said control signal having a constant period in spite of variation in the revolutions per minute of the engine.

3. An ignition system for an internal combustion engine as set forth in claim 2, wherein said ignition preventing semiconductor switch is connected to short a portion of said ignition circuit when turned on by said control signal.

4. An ignition system for an internal combustion engine as set forth in claim 1, wherein said pulse generating circuit comprises an oscillating circuit and a duty control circuit to receive an output from said oscillating circuit to generate said pulse signal having a given pulse width.

* * * * *